US008649916B2

(12) United States Patent
Woo et al.

(10) Patent No.: US 8,649,916 B2
(45) Date of Patent: Feb. 11, 2014

(54) CONTROL SYSTEM

(75) Inventors: Derek K Woo, Rockledge, FL (US); Carlos S Paulino, Melbourne, FL (US); Robert F Bryant, Palm Bay, FL (US)

(73) Assignee: General Electric Company, Schenectady, NY (US)

( * ) Notice: Subject to any disclaimer, the term of this patent is extended or adjusted under 35 U.S.C. 154(b) by 205 days.

(21) Appl. No.: 13/175,073

(22) Filed: Jul. 1, 2011

(65) Prior Publication Data

US 2013/0006443 A1 Jan. 3, 2013

(51) Int. Cl.
*B61L 3/00* (2006.01)

(52) U.S. Cl.
USPC ..... 701/2; 246/187 A; 701/19

(58) Field of Classification Search
USPC ..... 701/2, 19, 20, 93; 246/187 A
See application file for complete search history.

(56) References Cited

U.S. PATENT DOCUMENTS

RE39,011 E * 3/2006 Horst et al. ..... 246/187 A
RE39,210 E * 8/2006 Horst et al. ..... 246/187 A
RE39,758 E * 8/2007 Horst et al. ..... 246/187 A
8,070,108 B2 * 12/2011 Severson ..... 246/1 R
8,280,569 B2 * 10/2012 Kumar et al. ..... 701/20
2008/0077285 A1 * 3/2008 Kumar et al. ..... 701/19
2010/0330875 A1 * 12/2010 Severson ..... 446/454
2012/0016542 A1 * 1/2012 Severson ..... 701/19
2012/0303237 A1 * 11/2012 Kumar et al. ..... 701/93

OTHER PUBLICATIONS

Ultimate Power—Freight Train, Unbounded—Distributed power: It's a bigger deal than you think, by David Lustig, Trains Magazine, Sep. 2010, pp. 23 to 33.

* cited by examiner

*Primary Examiner* — Helal A Algahaim
(74) *Attorney, Agent, or Firm* — Global Patent Operation; John A. Kramer

(57) ABSTRACT

A control system for rail vehicles includes an operator control unit in communication with an on-board transceiver housed in a rail vehicle. The operator control unit includes a selector manually movable to a plurality of pre-determined positions each position corresponding to one of at least the following modes of operation: FORWARD, REVERSE, and COAST, such that for each pre-determined position of the selector, the operator control unit sets the off-board control unit to the corresponding mode of operation.

11 Claims, 5 Drawing Sheets

CONTROL SYSTEM

FIELD OF THE INVENTION

Embodiments of the invention relate generally to control systems, and, more particularly, to remote control of rail vehicle traction power systems.

BACKGROUND OF THE INVENTION

Rail car switching, shunting, and classification are integral aspects of rail freight operations. These procedures are performed in switching yards or classification yards, which include multiple rail tracks branching from one or more lead tracks and joining together at one or more exits. To maximize operational efficiency, several cars or trains of cars are typically moving simultaneously along different branches within a yard. Due to the presence of multiple stationary rail cars or stub trains on intervening tracks, an operator in a locomotive moving on a first track may not be able to see moving cars on a track branching from the first track. Accordingly, locomotive operators may coordinate their actions via a yardmaster stationed in a control tower overlooking the yard.

Three-way communication between operators and a yardmaster can introduce lag time and error, which are undesirable while moving multiple pieces of heavy rail equipment. As such, some yards include systems that utilize a yardmaster to remotely control and coordinate movement of multiple stub trains.

Remote monitoring and operation of rail equipment may also be useful in other contexts. For example, known systems are used in the coal and iron ore industries for rail car loadout or control of a dumper track. These systems require closely coordinating linear movement of a train along a loading track, with simultaneous adjustment of bulk cargo flow from a dump chute into open cars of the train.

As will be appreciated, when simultaneously monitoring and coordinating multiple stub trains, or when operating loader/dumper systems, yardmasters can benefit from using an intuitive multi-mode operator control unit (OCU) to control each train.

BRIEF DESCRIPTION OF THE INVENTION

Embodiments of the invention provide a multi-mode operator control unit for use in remotely controlling rail vehicles.

In one embodiment, an inventive control system includes an off-board control unit configured for communication with at least one on-board transceiver, and an operator control unit operatively connected with the off-board control unit and including a manually movable selector. The selector may be manually movable to any of a plurality of pre-determined positions each corresponding to one of at least the following modes of operation: FORWARD, REVERSE, and COAST. For each pre-determined position of the selector the operator control unit sets the off-board control unit to operate in the corresponding operating mode.

In another embodiment, an inventive control system includes an off-board control unit at least one on-board transceiver mounted in a rail vehicle and connected in communication with at least one traction power system of the rail vehicle. The system also includes an operator control unit operatively connected with the off-board control unit. The operator control unit includes a first button and a second button. The first button is operable to set the off-board control unit to a STOP mode of braking. The second button is operable to set the off-board control unit to a PARK mode of braking. While operating in the STOP mode the off-board control unit is configured to send to the on-board transceiver a locomotive braking signal. While operating in the PARK mode the off-board control unit is configured to send to the on-board transceiver a train braking signal.

In another embodiment, an inventive control system includes an off-board control unit configured for communication with at least one on-board transceiver mounted in a rail vehicle and operatively coupled with at least one distributed traction power system of the rail vehicle. The off-board control unit is operable at least in FORWARD, REVERSE, and COAST modes. The off-board control unit is configured to store a last ordered speed when entering the COAST mode of operation. While operating in the COAST mode, the off-board control unit is configured to intermittently determine, based on comparison of a measured vehicle speed to the last ordered speed, whether to send to the on-board transceiver a signal initiating rail vehicle braking.

In one embodiment, an inventive article includes non-transitory computer readable media encoded with one or more sets of instructions. When executed by a controller of a rail vehicle, the instructions cause the controller to operate according to one of a plurality of modes of operation. In a first mode of operation, the controller operates an on-board control unit portion of the controller to idle a traction power system and to continuously apply all brakes of the rail vehicle to achieve and maintain zero measured vehicle speed. In a second mode of operation, the controller operates the on-board control unit to idle the traction power system and to continuously apply selected brakes of the rail vehicle to achieve and maintain zero measured vehicle speed. In a first motive mode of operation, the controller operates the on-board control unit to adjust the traction power system of the rail vehicle to achieve measured vehicle speed matching an ordered vehicle speed. In a second motive mode of operation, the controller operates the on-board control unit to idle a traction power system of the rail vehicle and monitor measured vehicle speed.

In another embodiment, an inventive article includes non-transitory computer readable media encoded with one or more sets of instructions. When executed by a controller of a rail vehicle, the instructions cause the controller to respond to signals received from an off-board control unit. Responsive to a first signal received from an off-board control unit, the first signal indicative of a first mode of operation, the controller is configured to idle a traction power system of the rail vehicle and continuously apply all brakes of the rail vehicle to achieve and maintain zero measured vehicle speed. Responsive to a second signal received from the off-board control unit, the second signal indicative of a second mode of operation, the controller is configured to idle the traction power system and continuously apply selected brakes of the rail vehicle to achieve and maintain zero measured vehicle speed. Responsive to a third signal received from the off-board control unit, the third signal indicative of a third mode of operation, the controller is configured to adjust the traction power system to achieve measured vehicle speed matching an ordered vehicle speed. Responsive to a fourth signal received from the off-board control unit, the fourth signal indicative of a fourth mode of operation, the controller is configured to idle the traction power system and monitor measured vehicle speed.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
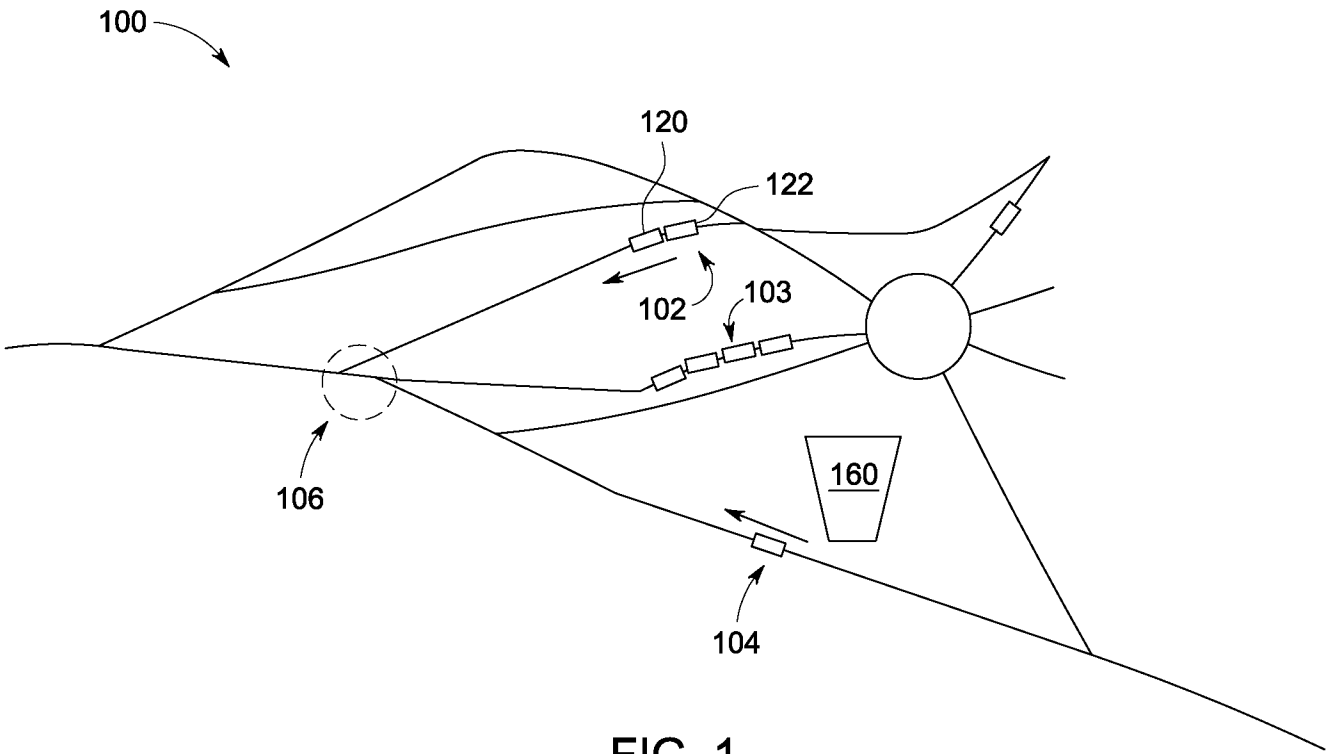
FIG. 1 is a schematic plan view of a rail classification yard.

Reference will be made below in detail to exemplary embodiments of the invention, examples of which are illustrated in the accompanying drawings. Wherever possible, the same reference numerals used throughout the drawings refer to the same or like parts.

FIG. 1 shows in a schematic view a rail classification yard 100, in which three trains 102, 103, 104 are positioned. Train 102 and locomotive 104 both are moving along separate tracks toward a common junction 106, and will arrive at approximately the same time. Both trains 102 and 104 are stub trains. Train 102 consists of car 120 pushed by locomotive 122. Train 104 consists solely of a locomotive. Importantly, intermediate train 103 obscures visibility of train 102 from locomotive 104 and also obscure visibility of locomotive 104 from locomotive 122. Thus, if the two trains are individually operated, it is possible that they will in fact collide at the common junction 106. As discussed above, one solution to this problem has been to remotely control trains within a yard, from an elevated location such as a yard control tower 160.

Figure 2:
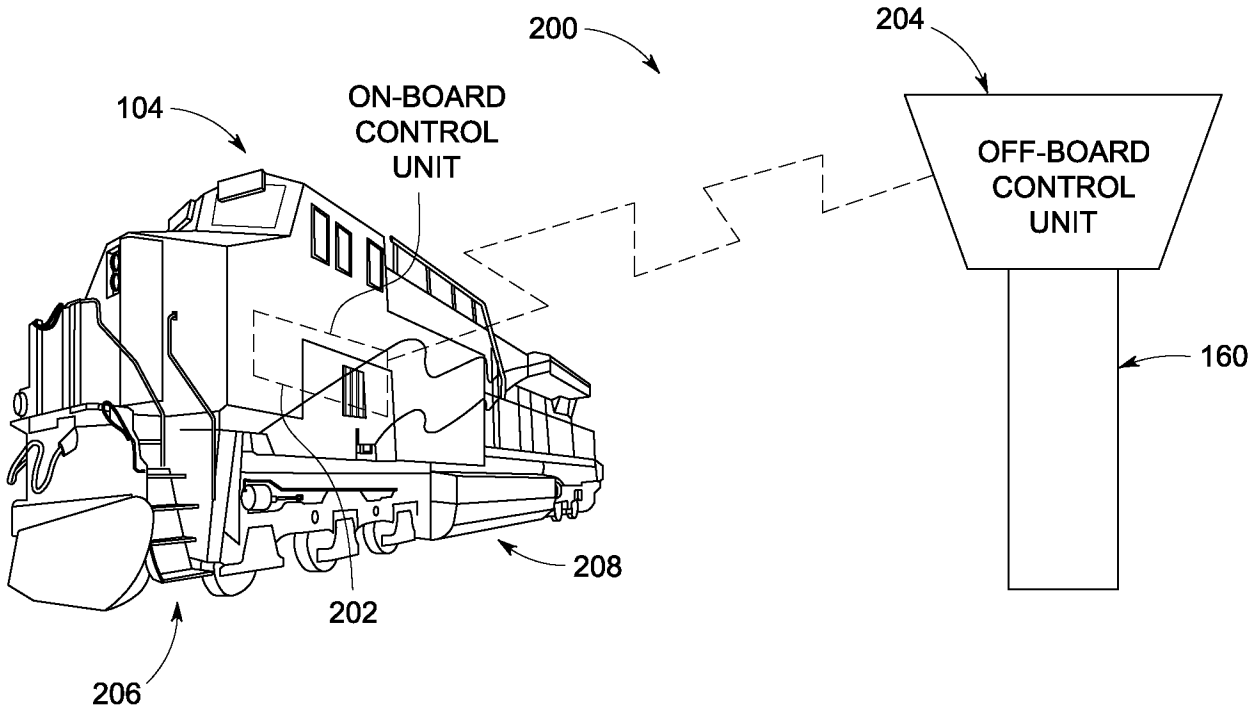
FIG. 2 is a first schematic view of equipment for remote operation of one or more vehicles within a classification yard, according to an embodiment of the present invention.

Referring to FIG. 2, one embodiment of a remote control system 200 includes a transceiver 202 onboard a train or other rail vehicle and in communication with an off-board control unit 204. The on-board transceiver 202 is in communication with a traction power system 206 and with sensors 208 that also are onboard the train. Although wireless radio communication will be shown and described hereinafter, the invention is not so limited, and may include at least laser, acoustic, or through-rail electrical modes of communication as well as any equivalents apparent to those of ordinary skill in light of this disclosure. In particular embodiments, the traction power system 206 is a distributed power system, in which the on-board transceiver 202 is in communication with, and controls, a plurality of fundamentally separate traction power sources that are temporarily joined together—e.g., two or more locomotives hitched in a single train. However, the invention is not limited solely to distributed traction power systems, but is equally applicable to rail vehicles or trains with only a single source of traction power.

Figure 3:
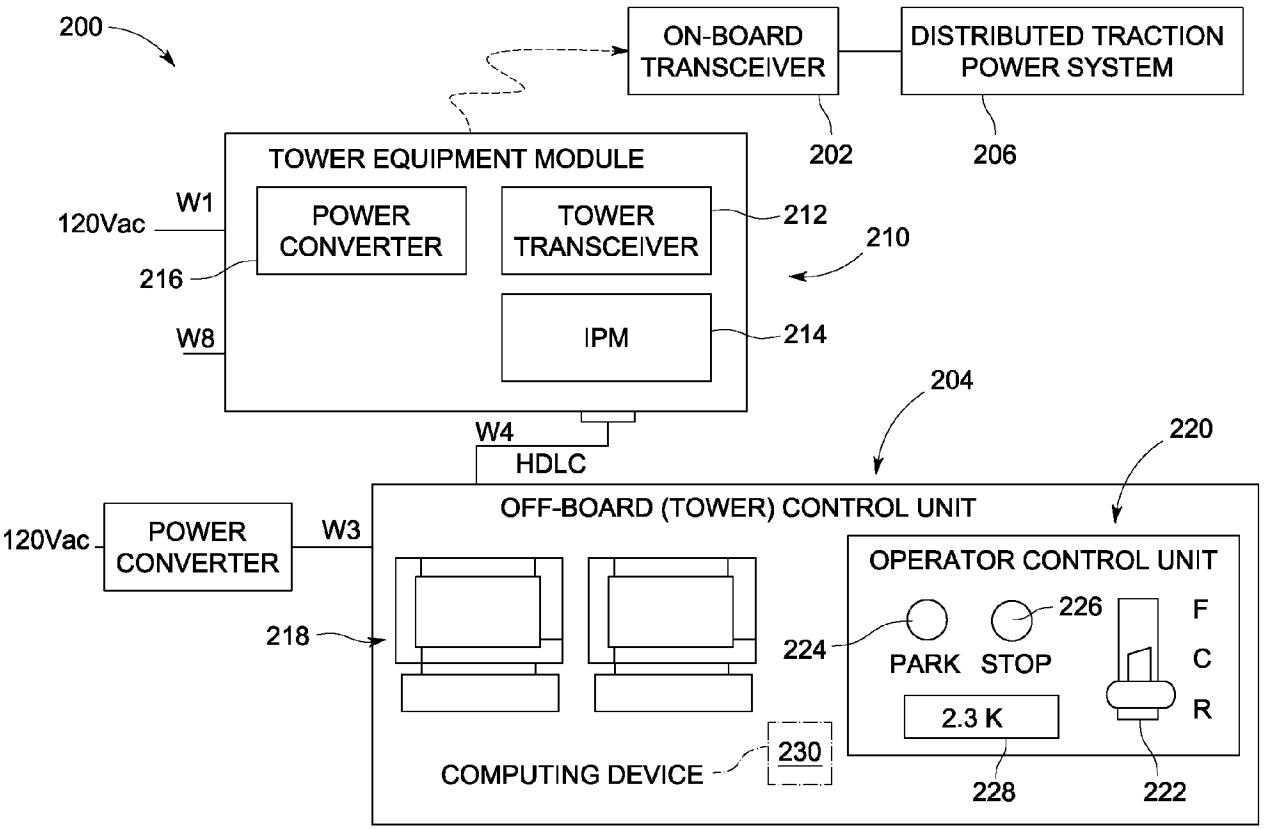
FIG. 3 is a second schematic view of equipment shown in FIG. 2, including a computing device.

FIG. 3 shows further details of the control system 200, which may include a tower equipment module 210 that houses a tower transceiver 212 for intermediating communication between the off-board control unit 204 and the on-board transceiver 202. The tower equipment module also may house an integrated processor module (IPM) 214 and a power converter 216. In some embodiments, the power converter receives 120 Vac and supplies 13.6 and 72 Vdc.

As shown in FIG. 3, according to one embodiment of the invention, the off-board control unit 204 includes multiple displays 218 on which a desired speed setting and measured vehicle speed are shown, as well as an operator control unit (OCU) 220. Each display is a remote session based device connected to the IPM 214, which handles all control signals and train data for the operator displays 218. The OCU 220 includes at least the following controls: a multi-position selector 222, as well as a PARK button 224 and a STOP button 226. In some embodiments, the OCU also may include an auxiliary display 228 as shown. In some embodiments, the selector 222 may include a dial, a switch, a position encoder, or any equivalent device suitable for selecting among more than two options. In some embodiments, the buttons 224, 226 may be spring-return push buttons. Toggle switches, sliders, or the like are equally suitable. In certain embodiments, the functions of the two buttons 224, 226 may be combined into a single component, for example, a three-way selector switch. In select embodiments the functions of the two buttons 224, 226 may be combined into the selector 222, or the buttons may be mounted on the selector. The selector 222 as well as the buttons 224, 226 and the optional display 228 are shown and described herein as being physically separate components within an assembled unit, however, one of ordinary skill will appreciate that the displays 218 and the OCU 220 equally can be implemented partly or entirely via a single advanced interface such as a touch-screen.

The displays 218, 228 and the OCU 220 are coordinated by a computing device 230. "Computing device" as used herein refers to either a general purpose integrated circuit, a custom ASIC, an FPGA, a custom analog circuit, or other like device. As shown in FIG. 3, the computing device 230 is connected with the integrated processor module 214 via a point-to-point high-level data link control ("HDLC") layer. In certain embodiments, the functionality of the computing device 230 may be implemented in the IPM 214 itself.

Figure 4:
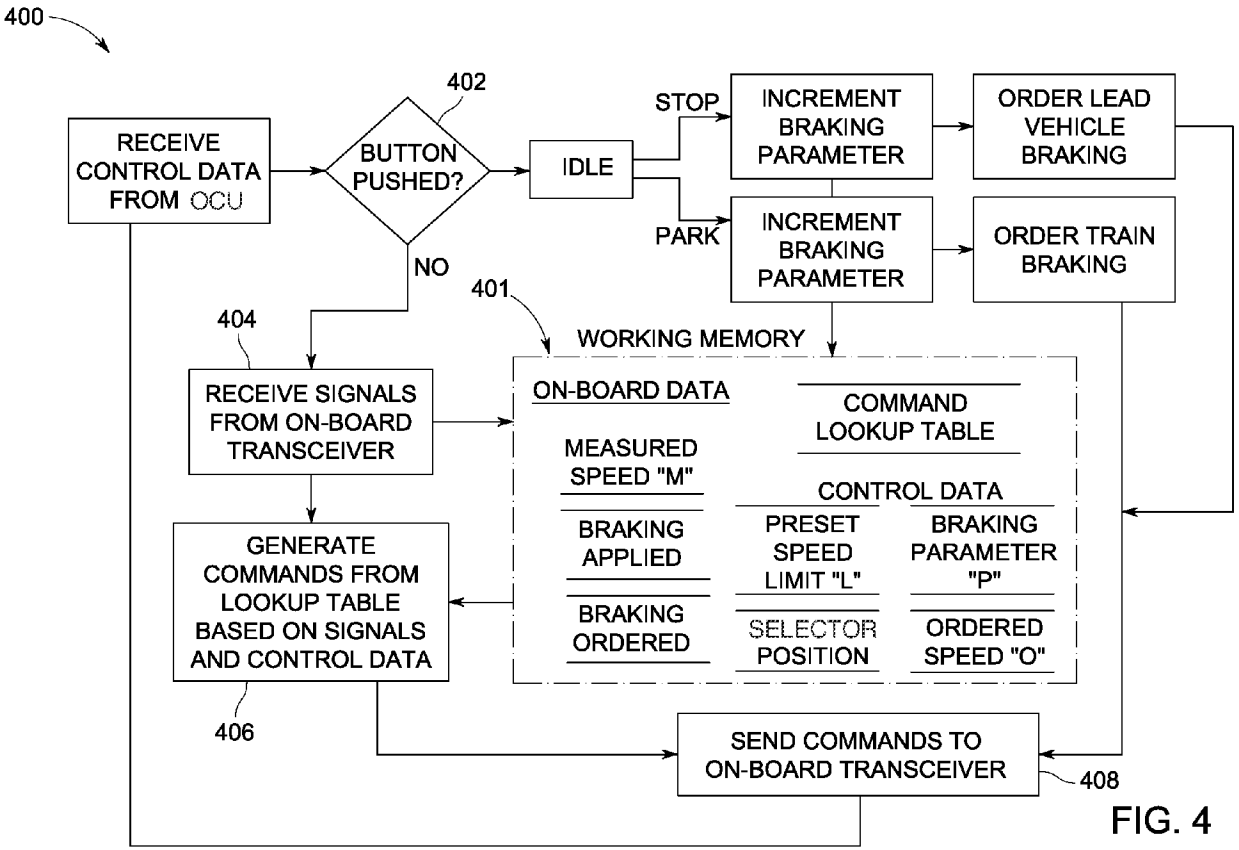
FIG. 4 is a schematic view of an operating process performed by the computing device shown in FIG. 3, according to one embodiment of the present invention.

As illustrated in FIG. 4, the computing device 230 is configured to implement a continuous-loop control process 400 for generating and sending commands to the on-board transceiver 202 via the IPM 214 and the tower transceiver 212. In implementation of the process 400, the computing device 230 makes use of a working memory 401. The working memory 401 may be composed of any electronically or optically read-writeable media, such as EEPROM, NAND flash, SDRAM, a hard drive, an optical disc, vacuum tubes, a capacitor bank, or other equivalent structures apparent to those of ordinary skill.

Each iteration of the process 400 includes a step 402 of checking whether one of the buttons 224 or 226 has been pressed to set a braking mode of operation within the off-board control unit. Pressing one of the STOP button 224 or the PARK button 226 causes the computing device 230 to generate and send to the on-board transceiver 202, via the tower transceiver 212, commands that idle the traction power system and that order braking of a locomotive or of an entire train, respectively. In some embodiments, repeatedly pressing one of the buttons, or holding down one of the buttons for a prolonged time, causes the computing device 230 to increment a braking parameter "P" that is stored in the working memory 401, and that also is sent to the on-board transceiver 202 to control the force with which braking systems are applied. In select embodiments, the braking parameter may be incremented by a percentage (e.g., five percent (5%)) or by a predetermined value each time a button is pressed, or around once per second during a prolonged button push.

After checking for button pushes, the process 400 proceeds to a step 404 of receiving signals from the on-board transceiver. The computing device 230 stores received signals in the working memory 401 as on-board data. The on-board data may include a measured speed "M" as well as indications that braking has been applied or that a braking order has been received in the rail vehicle where the on-board transceiver is installed. The measured speed "M" may be obtained by the on-board transceiver from a locomotive control system on some locomotives or from a trainline interface module (TIM) on some other locomotives.

Next, at a step 406 the computing device 230 generates commands to be sent to the on-board transceiver. The commands are generated according to an algorithm 500 (as further discussed with reference to FIG. 5), based on the on-board data and control data and internal signals stored in the working memory 401. Exemplary on-board data has been discussed above. The control data may include the braking parameter "P", a preset speed limit "L", a selector position "H", and an ordered speed "0".

Figure 5:
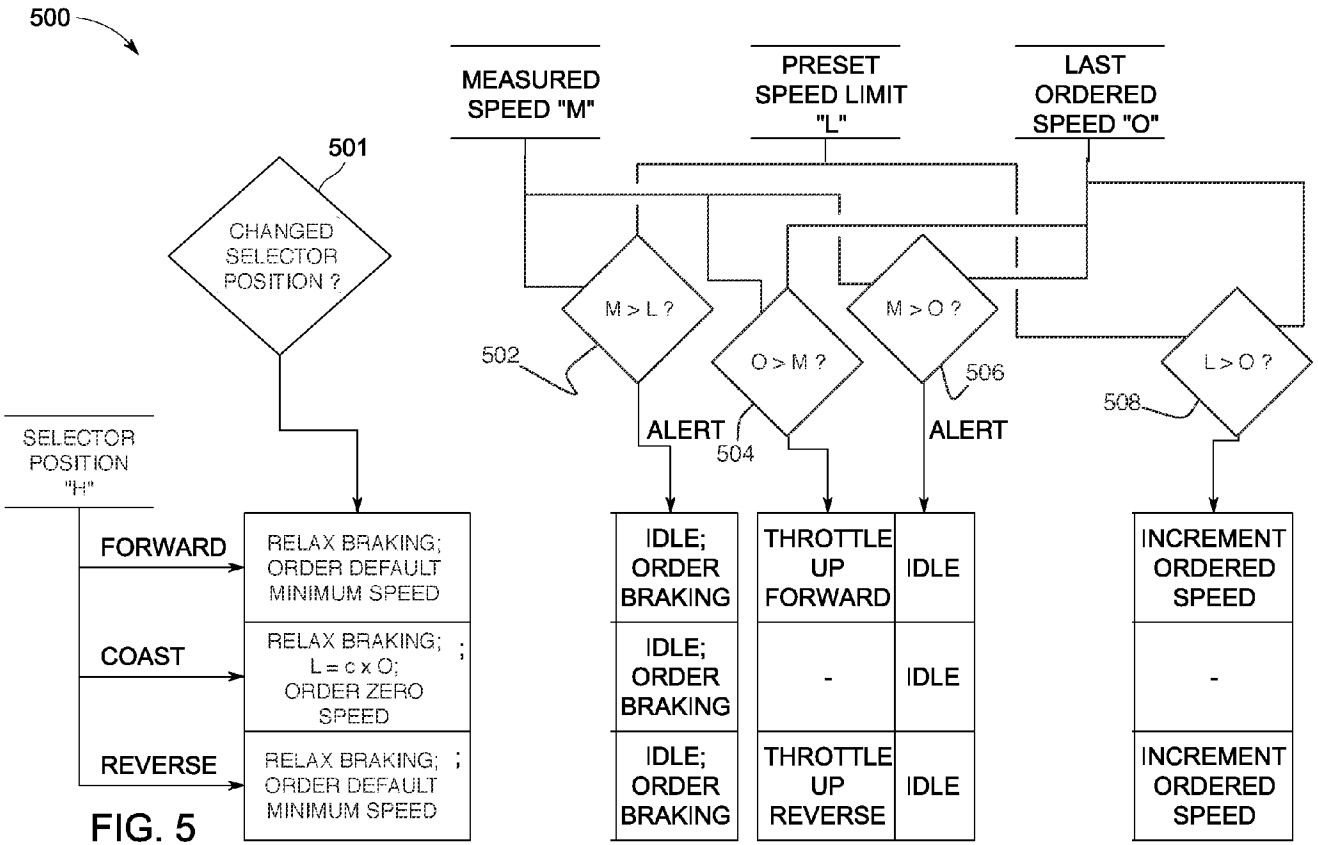
FIG. 5 is a schematic view of a lookup table used in the process shown in FIG. 4, according to one embodiment of the present invention.

FIG. 5 shows in schematic view a lookup table representation of one embodiment of the algorithm 500 that is used by the computing device 230 to generate the commands. At a first step 501, the algorithm checks whether position of the selector 222 has changed since the previous execution of the algorithm. In some embodiments, changing position of the selector 222 sets the off-board control unit 204 to a motive mode of operation. Exemplary motive modes of operation are further discussed below.

For example, at step 501, if the selector has just been repositioned to CENTER from FORWARD or from REVERSE, the commands "C" will include an order to relax or remove braking forces, as well as an order setting "O" to zero speed and an order to idle the traction power system. Those of ordinary skill will apprehend that "idle" can mean minimum choke, zero-torque fuel injection programming, open circuit, shunted, or equivalent minimal power modes according to the specific structure of the distributed power system. This mode of operation associated with the selector CENTER position also is described as COAST. In the described embodiment, COAST mode is made available by transition back to CENTER from one of FORWARD or REVERSE modes, which are further described below.

In other embodiments, suitable for control of individual rail cars where a significant grade change will occur on HUMP yards, when selector position change is detected at CENTER this can drive an immediate "order braking". Then, while the control remains in COAST and the rail vehicle measured speed remains below a limit "L" based on the last order speed "O", the off-board control unit can continuously send a follow-on order to defer or delay braking.

In the embodiment shown in FIG. 5, each time the selector is found in a FORWARD or REVERSE position, the system release braking and increments the ordered speed "O". For example the selector may be positioned from COAST (the CENTER neutral position) to FORWARD, in order to disengage STOP or PARK braking. In some embodiments the selector may also be repeatedly pushed to FORWARD and released to CENTER so as to increment ordered speed "O" in small steps. In some embodiments, continuously holding the selector to FORWARD or to REVERSE will cause timed increments of ordered speed "O" toward a limit "L", as shown at step 507.

In other embodiments, the ordered speed "O" is a preset constant speed that is less than the preset constant speed limit "L". In these other embodiments, when the selector is pushed FORWARD, braking will be released and the train will be commanded to move at a preset speed in the FORWARD Direction. When the selector is pulled in REVERSE, braking will be released and the train will be commanded to move at a preset speed in the REVERSE Direction.

Taking into account the present selector position "H", at steps 502, 504, 506, 508, the algorithm then generates a group of commands "C" based on a series of numeric comparisons measured speed "M", preset speed limit "L", and last ordered speed "O".

At step 502, if the measured speed "M" exceeds the preset speed limit "L", the IPM will activate an ALERT via the operator control unit, and will activate braking and idle the vehicle traction power system via the tower transceiver and on-board transceiver.

At step 504, if the ordered speed "O" is greater than the measured speed "M", and if the selector position "H" is one of FORWARD or REVERSE, the IPM will initiate a "throttle up" command to the vehicle traction power system, via the tower transceiver and the on-board transceiver.

At step 506, if the measured speed "M" exceeds ordered speed "O", then the IPM will idle the vehicle traction power system. Additionally, in some embodiments, if the system is operating in COAST mode, the IPM also will activate locomotive, train, or vehicle braking and activate a second ALERT until the measured speed diminishes to match the ordered speed, only if the measured speed "M" begins to exceed the preset speed limit "L". In select embodiments, when the system enters the COAST mode of operation, the preset speed limit may be reset equal to a fraction of then current ordered speed "O". For example the speed limit "L" may be set equal to "c×O" wherein "c" is between about 0.7 and about 1.3. In one embodiment "c" may be about 1.2. If the measured speed "M" also exceeds the preset speed limit "L", the algorithm will further add an order for braking that will over-ride the order to relax braking. In select embodiments, the preset speed limit "L" may be reset to a default value when the system exits the COAST mode.

Some embodiments include step 508, wherein if the ordered speed "O" is less than the preset speed limit "L", and if the selector position "H" is one of FORWARD or REVERSE, then the IPM increments the ordered speed.

Any of these above described embodiments may be implemented using a standard spring-to-neutral joystick as the selector 222.

Once the algorithm 500 has finished compiling or generating the set of commands, the process 400 then continues through a step 408 of sending the commands to the on-board transceiver and back to the step 402 of checking whether one of the buttons STOP or PARK has been pressed.

In operation of one embodiment of the inventive system, the off-board control unit 204 receives system monitoring signals from the on-board transceiver 202, checks for stored control data and internal command signals from the components of the control unit, generates commands based on the received signals, the internal signals, and the control data, and sends the generated commands to the on-board transceiver. The off-board control unit 204 may generate commands based on a lookup table algorithm or the like, of which one embodiment is shown in FIG. 5.

In some embodiments, the off-board control unit 204 sends relatively generalized or "high level" commands. In select embodiments, the commands may include, by way of example, "order braking" along with a "braking parameter" that may indicate a desired acceleration. In such embodiments, the on-board transceiver 202 is configured to translate the braking order and the braking parameter into specific control signals applicable to the brake systems of the vehicle on which the on-board transceiver is carried. Similarly, the commands may include "throttle up" along with an ordered speed. In such embodiments, the on-board transceiver 202 is configured to translate the throttle up command and the ordered speed into a throttle control signal. In certain embodiments, the on-board transceiver 202 accomplishes this translation based at least in part on a concurrently measured speed of the vehicle in which the on-board transceiver is carried.

In other embodiments, the off-board control unit 204 sends relatively specific or "machine level" commands. In select embodiments, the "order braking" and "braking parameter" commands may simply be relayed by the on-board transceiver 202 to the braking system of the vehicle in which the on-board transceiver is carried. In such embodiments, the off-board control unit 204 may be reconfigured to send different machine level commands, according to the on-board transceiver 202 with which it is to be used.

The signals received from the on-board transceiver 202 may include a measured speed, a flag whether braking is applied, and a flag whether braking is ordered. The internal signals may include button pushes as well as control selector positions such as FORWARD, COAST, or REVERSE.

In some embodiments, the off-board control unit 204 checks whether a STOP button or a PARK button has been pressed. Pressing the STOP button causes the off-board control unit 204 to buffer a command to apply brakes on a lead vehicle carrying the on-board transceiver. Pressing the PARK button causes the off-board control unit 204 to buffer a command to apply brakes on each car of a train that includes a lead vehicle carrying the on-board transceiver. In select embodiments, the STOP and PARK commands take precedence over any other commands buffered by the control unit.

As an example of use, the inventive control system 200 can be operated to "spot" a train to a position where a tower indexer arm can move the train as known to the skilled worker. To spot the train, a tower operator can command the train to a RUN mode (via holding the selector 222 in a given direction) and based on measured speed of the train, can release the selector 222 to set the train to COAST mode when the momentum of the train can spot it to the desired location. In some embodiments, during COAST mode, the tower control unit 204 stores the last operator commanded speed for the train and ensures the train does not exceed a limit based on that stored speed. In one embodiment, the tower control unit 204 causes the train brakes to be applied before the measured train speed exceeds 120% of the stored speed.

In use, an embodiment of an inventive control system may include at least one on-board transceiver mounted in a rail vehicle and connected in communication with at least one distributed traction power system of the rail vehicle. The control system also may include an off-board control unit in communication with the at least one on-board transceiver, and an operator control unit operatively connected with the off-board control unit and including a manually movable selector. The selector may be manually movable to any of a plurality of pre-determined positions each corresponding to one of at least the following modes of operation: FORWARD, REVERSE, and COAST. For each pre-determined position of the selector the operator control unit sets the off-board control unit to operate in the corresponding mode.

In select embodiments, the COAST position may be intermediate or centered between FORWARD and REVERSE. The selector may be spring-returned to the neutral or COAST position. The off-board control unit may send to the on-board transceiver a signal indicating an ordered speed. While operating in the FORWARD mode or in the REVERSE mode, the off-board control unit periodically increments the ordered speed. The off-board control unit may not increment the ordered speed beyond a pre-determined maximum speed. In some embodiments, the pre-determined maximum speed is set equal to a pre-determined coasting speed. While operating in the COAST mode, the off-board control unit may send to the on-board transceiver a first signal indicating the ordered speed is a pre-determined coasting speed and a second signal for idling the distributed traction power system. When entering the COAST mode of operation the off-board control unit may store a last ordered speed, and while operating in the COAST mode the off-board control unit may send to the on-board transceiver a signal activating autonomous rail vehicle braking, receive from the on-board transceiver a signal indicating measured vehicle speed, and based on comparison of the measured vehicle speed to the last ordered speed, determine whether to send to the on-board transceiver a signal delaying rail vehicle braking. In some embodiments, the off-board control unit may receive from the on-board transceiver a signal indicating a measured vehicle speed. While operating in the COAST mode the off-board control unit may compare the measured vehicle speed to a pre-determined coasting speed. In select embodiments, based on comparing the measured vehicle speed to a pre-determined coasting speed, the off-board control unit may send to the on-board transceiver a signal ordering rail vehicle braking. In some embodiments, based on comparing the measured vehicle speed to the ordered speed, the off-board control unit sends to the on-board transceiver a signal for adjusting the distributed traction power system.

In other embodiments, an inventive control system may include at least one on-board transceiver mounted in a rail vehicle and connected in communication with at least one distributed traction power system of the rail vehicle. The system also includes an off-board control unit in communication with the at least one on-board transceiver, and an operator control unit operatively connected with the off-board control unit. The operator control unit includes a first button and a second button. The first button is operable to set the off-board control unit to a STOP mode of braking and to increment a braking parameter within the off-board control unit. The second button is operable to set the off-board control unit to a PARK mode of operation and to increment a braking parameter within the off-board control unit. While operating in the STOP mode the off-board control unit sends to the on-board transceiver a locomotive braking signal based on the braking parameter set by the first button. While operating in the PARK mode the off-board control unit sends to the on-board transceiver a train braking signal based on the braking parameter set by the second button. the operator control unit further including a selector positionable to any one of a FORWARD, a REVERSE, or a COAST position, each position selecting a corresponding mode of operation of the off-board control unit, wherein changing the selector position terminates operation in the PARK mode or the STOP mode and initiates operation in the mode corresponding to the selector position. In select embodiments, terminating operation in the PARK mode or the STOP mode resets the braking parameter. In certain embodiments, the first button increments a first braking parameter and the second button increments a second braking parameter. In some embodiments, the braking parameter is incremented based on duration of button push. In some embodiments, the braking parameter is incremented based on number of button pushes.

In other embodiments, an inventive control system includes at least one on-board transceiver mounted in a rail vehicle and connected in communication with at least one distributed traction power system of the rail vehicle, and an off-board control unit in communication with the at least one on-board transceiver and operable at least in FORWARD, REVERSE, and COAST modes. When entering the COAST mode of operation the off-board control unit stores a last ordered speed, and while operating in the COAST mode the off-board control unit intermittently determines, based on comparison of a measured vehicle speed to the last ordered speed, whether to send to the on-board transceiver a signal initiating rail vehicle braking. In some embodiments, when entering the COAST mode of operation the off-board control unit sends to the on-board transceiver a signal activating autonomous vehicle braking.

In one embodiment, an inventive article includes non-transitory computer readable media encoded with one or more sets of instructions. When executed by a controller of a rail vehicle, the instructions cause the controller to operate according to one of a plurality of modes of operation. In a first mode of operation, the controller operates an on-board control unit portion of the controller to idle a traction power system and to continuously apply all brakes of the rail vehicle to achieve and maintain zero measured vehicle speed. In a second mode of operation, the controller operates the on-board control unit to idle the traction power system and to continuously apply selected brakes of the rail vehicle to achieve and maintain zero measured vehicle speed. In a first motive mode of operation, the controller operates the on-board control unit to adjust the traction power system of the rail vehicle to achieve measured vehicle speed matching an ordered vehicle speed. In a second motive mode of operation, the controller operates the on-board control unit to idle a traction power system of the rail vehicle and monitor measured vehicle speed.

In another embodiment, an inventive article includes non-transitory computer readable media encoded with one or more sets of instructions. When executed by a controller of a rail vehicle, the instructions cause the controller to respond to signals received from an off-board control unit. Responsive to a first signal received from an off-board control unit, the first signal indicative of a first mode of operation, the controller is configured to idle a traction power system of the rail vehicle and continuously apply all brakes of the rail vehicle to achieve and maintain zero measured vehicle speed. Responsive to a second signal received from the off-board control unit, the second signal indicative of a second mode of operation, the controller is configured to idle the traction power system and continuously apply selected brakes of the rail vehicle to achieve and maintain zero measured vehicle speed. Responsive to a third signal received from the off-board control unit, the third signal indicative of a third mode of operation, the controller is configured to adjust the traction power system to achieve measured vehicle speed matching an ordered vehicle speed. Responsive to a fourth signal received from the off-board control unit, the fourth signal indicative of a fourth mode of operation, the controller is configured to idle the traction power system and monitor measured vehicle speed. In select embodiments, the article also is encoded with instructions to configure an off-board control unit for wirelessly operating the controller.

Another embodiment relates to a system (e.g., a system for controlling rail vehicles) comprising an off-board control unit and an operator control unit. The off-board control unit is configured for communication with an on-board transceiver mounted in a rail vehicle; the on-board transceiver is of the type operatively connected with at least one distributed power system of the rail vehicle. The operator control unit is operatively connected with the off-board control unit, and includes a selector manually movable to at least three pre-determined positions. The at least three pre-determined positions respectively correspond to at least three operational modes for a rail vehicle; the three operational modes are different from one another. For each pre-determined position, when the selector is moved to the position, the operator control unit generates selector signal(s) that are communicated to the off-board control unit; the selector signals contain information indicative of the pre-determined position (i.e., the position the selector was moved to) and/or the selected operational mode that corresponds to the position. In other words, since each pre-determined position corresponds to a different operational mode, the operator control unit can communicate either information of the position the selector was moved to or the selected operational mode that corresponds to that position. The off-board control unit is configured to transmit vehicle control signal(s) to the on-board transceiver, based on the selector signal(s) received from the operator control unit. The vehicle control signal(s) are indicative of the selected operational mode, and the distributed power system of the rail vehicle is responsive to the vehicle control signal(s) for control of the rail vehicle according to the selected operational mode.

As an example, in one embodiment, the selector is moveable to at least first, second, and third pre-determined positions. The first, second, and third pre-determined positions correspond to first, second, and third operational modes. The operator control unit is configured for the following: (1) when the selector is moved to the first pre-determined position, the operator control unit generates first selector signals indicative of the first pre-determined position and/or the first operational mode; (2) when the selector is moved to the second pre-determined position, the operator control unit generates second selector signals indicative of the second pre-determined position and/or the second operational mode; and (3) when the selector is moved to the third pre-determined position, the operator control unit generates third selector signals indicative of the third pre-determined position and/or the third operational mode. The off-board control unit is configured to receive the selector signals and to transmit vehicle control signals to the on-board transceiver, based on the selector signals. In particular, in this example, the off-board control unit is configured to: (1) responsive to receiving the first selector signals, transmit first vehicle control signals to the on-board transceiver, which are indicative of the first operational mode; (2) responsive to receiving the second selector signals, transmit second vehicle control signals to the on-board transceiver, which are indicative of the second operational mode; and (3) responsive to receiving the third selector signals, transmit third vehicle control signals to the on-board transceiver, which are indicative of the third operational mode. The vehicle controls signals are configured for control of the rail vehicle, and/or the rail vehicle is responsive to the signal for operation according to the various modes. Thus, upon the on-board transceiver receiving the first vehicle control signals, the rail vehicle is operated in the first operational mode, upon the on-board transceiver receiving the second vehicle control signals, the rail vehicle is operated in the second operational mode, and upon the on-board transceiver receiving the third vehicle control signals, the rail vehicle is operated in the third operational mode. In one embodiment, the first operational mode is a vehicle "forward" mode, meaning the vehicle is controlled to move in a forward direction (this may also include a braking aspect if the vehicle is currently moving in reverse), the second operational mode is a vehicle "reverse" mode, meaning the vehicle is controlled to move in a reverse direction (this may also include a braking aspect if the vehicle is currently moving forward), and the third operational mode is a vehicle "coast" mode, meaning the vehicle is de-throttled, while either moving forward or reverse, to move forward under inertia only.

Another embodiment relates to a system, e.g., a system for controlling a train or other rail vehicle. The system comprises an off-board control unit configured for communication with at least one on-board transceiver, which is mounted in a rail vehicle and operatively connected with at least one distributed power system of the rail vehicle. The system further comprises an operator control unit operatively connected with the off-board control unit and including a first button and a second button. The first button is operable to set the off-board control unit to a first mode of operation. The second button is operably to set the off-board control unit to a different, second mode of operation. The off-board control unit is configured, while operating in the first mode, to send to the on-board transceiver a first braking signal. The off-board control unit is further configured, while operating in the second mode, to send to the on-board transceiver a different, second braking signal. The first braking signal may be configured for controlling the rail vehicle (e.g., the rail vehicle is responsive to the first braking signal) to bring the rail vehicle to a stop. The second braking signal may be configured for controlling the rail vehicle (e.g., the rail vehicle is responsive to the second braking signal) to engage one or more auxiliary braking systems of the rail vehicle, for parking the rail vehicle. For example, the first braking signal may engage a first braking system of the rail vehicle, and the second braking signal may engage a different, second braking system of the rail vehicle. As another example, in the case of a train, the first braking signal may engage the brakes of a locomotive of the train, or more than one locomotive of the train, and the second braking signal may engage the brakes of all cars in the train.

Another embodiment relates to a system, e.g., for controlling a rail vehicle. The system comprises an off-board control unit in communication with at least one on-board transceiver, which is mounted in a rail vehicle and operatively coupled with at least one distributed power system of the rail vehicle. The off-board control unit is operably in at least first, second, and third modes corresponding to controlling the rail vehicle to move in a forward direction, to move in a reverse direction, and to coast (e.g., throttle disengaged and the rail vehicle moving due to inertia and/or gravity), respectively. The off-board control unit is configured, when entering the third mode, to store a last ordered speed. The off-board control unit is further configured, while operating in the third mode, to intermittently determine, based on a comparison of a measured vehicle speed to the last ordered speed, whether to send to the on-board transceiver a signal initiating rail vehicle braking.

Various embodiments relate to systems that comprise an off-board control unit configured for communication with an on-board transceiver mounted in a rail vehicle, wherein the on-board transceiver is operatively connected with at least one traction power system of the rail vehicle. The traction power system may be a distributed power system of the rail vehicle. A distributed power system is one in which a vehicle includes transceiver equipment for communicating with other vehicles, for coordinated control of vehicle traction (e.g., throttle and braking). Thus, in a distributed power system, when plural vehicles (equipped with distributed power transceivers and related equipment) are linked together in a consist (e.g., train), traction among the vehicles is coordinated during operation of the consist. For example, in a distributed power train including a lead locomotive and plural trail or remote locomotives, when the throttle level of the lead locomotive is increased, the distributed power system automatically communicates information of the throttle level increase to the trail or remote locomotives, which correspondingly increase their own throttle levels. In embodiments of the invention: (i) the on-board transceiver is a distributed power transceiver, configured to both communicate with the off-board control unit and with other transceivers, e.g., when the on-board transceiver is installed in a vehicle and the vehicle is linked with other distributed power-equipped vehicles in a consist, the on-board transceiver is configured to communicate with other on-board transceivers in the other vehicles of the consist; and/or (ii) the off-board control unit and the on-board transceiver are configured to communicate wirelessly over one or more communication channels that are dedicated for use in distributed power communications for a vehicle consist. In other words, in an embodiment, the on-board transceivers of a distributed power-equipped vehicle consist are configured to communicate over one or more channels dedicated (sole use for distributed power communications) or allocated (at least partial use for distributed power communications) to distributed power communications, and the off-board control unit also communicates over those one or more channels.

Another embodiment relates to a system comprising an off-board control unit and an operator control unit. The off-board control unit is configured for communication with an on-board transceiver mounted in a rail vehicle and operatively connected with at least one traction power system of the rail vehicle (e.g., the on-board transceiver may be operatively connected with a distributed power system of the rail vehicle that controls the traction power system). The operator control unit is operatively connected with the off-board control unit and includes a selector manually movable to a plurality of pre-determined positions. The off-board control unit is configured to automatically transmit to the on-board transceiver different vehicle control signals when the selector is moved to the different pre-determined positions; that is, for each pre-determined position, the off-board control unit automatically transmits a different vehicle control signal(s) to the on-board transceiver.

In one embodiment, for example, there are at least first, second, and third pre-determined positions. The off-board control unit is configured such that when the selector is moved to the first pre-determined position, the off-board control unit automatically transmits (to the on-board transceiver) first signals, responsive to which the traction power system is controlled to move the vehicle in a first direction (e.g., forward). The off-board control unit is further configured such that when the selector is moved to the second pre-determined position, the off-board control unit automatically transmits (to the on-board transceiver) second signals, responsive to which the traction power system is controlled to move the vehicle in a second direction (e.g., reverse). The off-board control unit is configured such that when the selector is moved to the third pre-determined position, the off-board control unit automatically transmits (to the on-board transceiver) third signals, responsive to which the traction power system controls the vehicle to idle its traction power system, for coasting.

In another embodiment, the operator control unit alternatively or additionally comprises first and second buttons or other manually-actuable actuators. The off-board control unit is configured to automatically transmit to the on-board transceiver different vehicle control signals when the first and second actuators are actuated. For example, in one embodiment, the off-board control unit is configured such that when the first actuator is actuated, the off-board control unit automatically transmits (to the on-board transceiver) fourth signals, responsive to which the vehicle is controlled for selective brakes of the vehicle to be applied, e.g., some but not all of the brakes. In this example, the off-board control unit is further configured such that when the second actuator is actuated, the off-board control unit automatically transmits (to the on-board transceiver) fifth signals, responsive to which the vehicle is controlled for all brakes of the vehicle to be applied. In the case of a train or other rail vehicle consist, applying selective brakes may include (i) applying one braking system of the train but not all braking systems of the train, or (ii) applying brakes of one or more vehicles of the consist but not of all the vehicles in the consist. Additionally, applying all the brakes may include (i) applying all braking systems of all vehicles in the consist, or (ii) applying at least some brakes of all vehicles of the consist.

One of ordinary skill in the art will understand that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person of ordinary skill in the art to practice the embodiments of invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described control system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A system comprising:

an off-board control unit configured for communication with an on-board transceiver mounted in a rail vehicle, said on-board transceiver being operatively connected with at least one traction power system of the rail vehicle for controlling the at least one traction power system; and an operator control unit operatively connected with the off-board control unit and including a selector manually movable to a plurality of pre-determined positions each position corresponding to one of at least the following modes of operation: FORWARD, REVERSE, and COAST, such that for each pre-determined position of the selector, the operator control unit sets the off-board control unit to the corresponding mode of operation, wherein the off-board control unit is configured to send to the on-board transceiver at least one signal indicating at least one of the ordered speed or, for each pre-determined position of the selector, the corresponding mode of operation, and the off-board control unit is configured, while operating in the FORWARD mode or in the REVERSE mode, to periodically increment the ordered speed.

2. The system as claimed in claim 1, wherein the selector position corresponding to COAST is intermediate between FORWARD and REVERSE.

3. The system as claimed in claim 1, wherein the off-board control unit does not increment the ordered speed beyond a pre-determined maximum speed.

4. The system as claimed in claim 3, wherein the pre-determined maximum speed is set equal to a pre-determined coasting speed.

5. The system as claimed in claim 1, wherein the off-board control unit is configured, while operating in the COAST mode, to send to the on-board transceiver a first signal indicating the ordered speed is a pre-determined coasting speed and a second signal for idling the traction power system.

6. A system as claimed in claim 1, wherein the off-board control unit is configured, when entering the COAST mode of operation, to store a last ordered speed, and while operating in the COAST mode, to send to the on-board transceiver a signal activating autonomous rail vehicle braking, to receive from the on-board transceiver a signal indicating measured vehicle speed, and based on a comparison of the measured vehicle speed to the last ordered speed, to determine whether to send to the on-board transceiver a signal delaying rail vehicle braking.

7. The system as claimed in claim 1, wherein the off-board control unit is configured to receive from the on-board transceiver a signal indicating a measured vehicle speed.

8. The system as claimed in claim 7, wherein the off-board control unit is configured, while operating in the COAST mode, to compare the measured vehicle speed to a pre-determined coasting speed and to send a braking signal in the event that the measured vehicle speed exceeds the pre-determined coasting speed.

9. The system as claimed in claim 7, wherein the off-board control unit is configured, based on comparing the measured vehicle speed to a pre-determined coasting speed, to send to the on-board transceiver a signal ordering rail vehicle braking.

10. The system as claimed in claim 7, wherein the off-board control unit is configured, based on comparing the measured vehicle speed to an ordered speed, to send to the on-board transceiver a signal for adjusting the traction power system.

11. The system as claimed in claim 1, wherein the selector is a joystick.

* * * * *

UNITED STATES PATENT AND TRADEMARK OFFICE

CERTIFICATE OF CORRECTION

PATENT NO. : 8,649,916 B2
APPLICATION NO. : 13/175073
DATED : February 11, 2014
INVENTOR(S) : Woo et al.

It is certified that error appears in the above-identified patent and that said Letters Patent is hereby corrected as shown below:

In the Specification

Column 4, Line 45, delete "STOP button 224" and insert -- STOP button 226 --, therefor.

Column 4, Line 46, delete "PARK button 226" and insert -- PARK button 224 --, therefor.

Column 6, Line 23, delete "of then" and insert -- of the --, therefor.

Column 8, Line 43, delete "the operator" and insert -- The operator --, therefor.

In the Claim

Column 14, Line 41, in Claim 6, delete "A system" and insert -- The system --, therefor.

Signed and Sealed this
Sixth Day of May, 2014

Michelle K. Lee

Michelle K. Lee
*Deputy Director of the United States Patent and Trademark Office*